US009625132B2

(12) United States Patent
Spitzer

(10) Patent No.: US 9,625,132 B2
(45) Date of Patent: Apr. 18, 2017

(54) LIGHT FIXTURE MOUNTING SYSTEM

(71) Applicant: Charles Spitzer, Brooklyn, NY (US)

(72) Inventor: Charles Spitzer, Brooklyn, NY (US)

( * ) Notice: Subject to any disclaimer, the term of this patent is extended or adjusted under 35 U.S.C. 154(b) by 208 days.

(21) Appl. No.: 14/662,909

(22) Filed: Mar. 19, 2015

(65) Prior Publication Data

US 2016/0273743 A1 Sep. 22, 2016

(51) Int. Cl.

| | |
|---|---|
| ***F21V 19/00*** | (2006.01) |
| ***F21V 21/03*** | (2006.01) |
| ***F21S 8/06*** | (2006.01) |

(52) U.S. Cl.

CPC ..... *F21V 21/03* (2013.01); *F21S 8/06* (2013.01)

(58) Field of Classification Search

CPC ..... F21S 8/06; F21V 21/02

See application file for complete search history.

(56) References Cited

U.S. PATENT DOCUMENTS

| | | | | |
|---|---|---|---|---|
| 6,761,463 | B2 * | 7/2004 | Hsu | F21S 8/04 362/147 |
| 2004/0246729 | A1 * | 12/2004 | Wu | F21V 21/02 362/406 |
| 2007/0147053 | A1 * | 6/2007 | Gagne | F21V 21/02 362/404 |

* cited by examiner

*Primary Examiner* — Evan Dzierzynski
(74) *Attorney, Agent, or Firm* — Fox Rothschild LLP

(57) ABSTRACT

A light fixture mounting system including a nipple assembly configured to be secured relative to a structure. The nipple assembly includes a longitudinally extending nipple with at least one longitudinal channel and a series of outer threads. A fixture mount assembly includes a mount body, a prong assembly extending from the mount body and including at least one prong leg extending to a free end with an outwardly extending prong foot, and an adjusting nut positioned about the at least one prong leg between the mount body and the respective prong foot. The fixture mount assembly is positioned relative to the nipple assembly such that each prong leg is positioned in a longitudinal channel and the adjusting nut is positioned such that the adjusting nut contacts the at least one prong foot and the at least one prong leg is retained in the corresponding longitudinal channel.

10 Claims, 5 Drawing Sheets

LIGHT FIXTURE MOUNTING SYSTEM

FIELD OF THE INVENTION

This invention relates to a light fixture mounting system. More particularly, the present invention relates to a light fixture mounting system configured to minimize the risk of inadvertent unscrewing of the mounting system.

BACKGROUND OF THE INVENTION

Referring to FIGS. 1-3, a prior art light fixture mounting system will be described. The prior art mounting system generally comprises a crossbar 10, mounting screws 13, a nipple 18, a lock nut 19 and a collar loop 20. The crossbar 10 is mounted to a light fixture box or the like (not shown) by inserting the mounting screws 13 into slotted holes 12 or alternate holes 14 of the crossbar 10. The nipple 18 is screwed into the central hole 16 of the crossbar 10 and the lock nut 19 is screwed onto the nipple 18 until it rests against the crossbar 10. The collar loop 20 is then threaded onto the nipple 18 and the light fixture is hung on the collar loop 20, most often via an open chain link (not shown) connected to the mounting loop 24. The light fixture is wired in a known manner and then the canopy 22 of the light fixture is positioned about the threads 21 of the collar loop 20 and secured by tightening the nut 23 of the collar loop 20.

While the prior art systems may initially secure the lighting fixture, there is a risk that the threaded connection between the nipple 18 and the collar loop 20 or the connection between the nipple 18 and the crossbar 10 may become disconnected whereby the lighting fixture may fall. This is a problem that is sometimes the result of cleaning, adjustment or other movement of the light fixture, which sometimes causes the nipple 18 to rotate and to thereby unscrew from the collar thread or crossbar 10. Additionally, the prior art system sometimes poses installation difficulties because the size of the nipple 18 can cause the canopy 22 to be less than tightly placed against the ceiling above the light fixture box or can cause the collar loop 20 to be less than tightly placed below the canopy 22. These placement difficulties are often not apparent or determined until after the installation is complete requiring disassembly to correct or adjust the nipple size.

SUMMARY OF THE INVENTION

In at least one aspect, the present invention provides a light fixture mounting system including a nipple assembly configured to be secured relative to a structure. The nipple assembly includes a longitudinally extending nipple with at least one longitudinal channel and a series of outer threads. A fixture mount assembly includes a mount body, a prong assembly extending from the mount body and including at least one prong leg extending to a free end with an outwardly extending prong foot, and an adjusting nut positioned about the at least one prong leg between the mount body and the respective prong foot. The fixture mount assembly is positioned relative to the nipple assembly such that each prong leg is positioned in a longitudinal channel and the adjusting nut is tightened such that the nut contacts the at least one prong foot and the at least one prong leg is thereby retained in the corresponding longitudinal channel.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
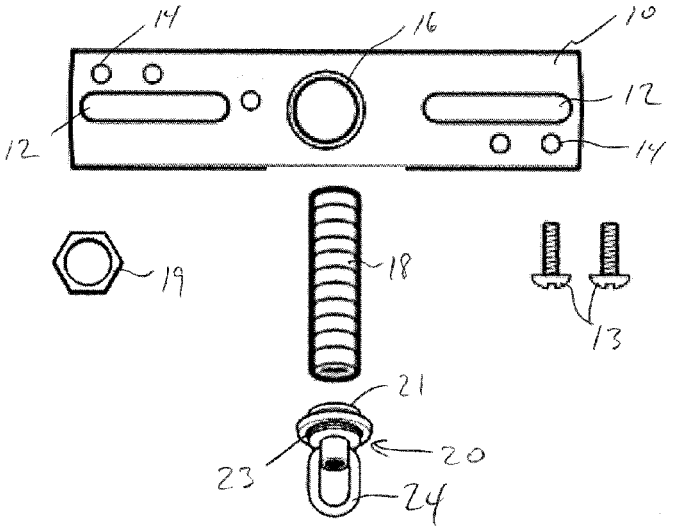
Fig. 1 (Prior Art)
FIG. 1 is an exploded view of a prior art mounting system.
Figure 2:
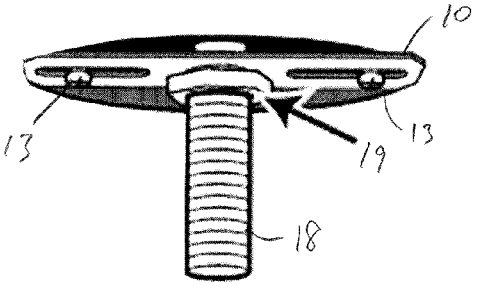
Fig. 2 (Prior Art)
FIG. 2 is a perspective view of the mounting system of FIG. 1 partially assembled.
Figure 3:
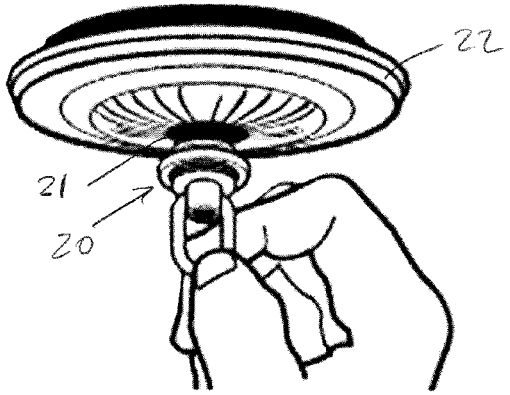
Fig. 3 (Prior Art)
FIG. 3 is a perspective view of the mounting system of FIG. 1 completing assembly.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 4:
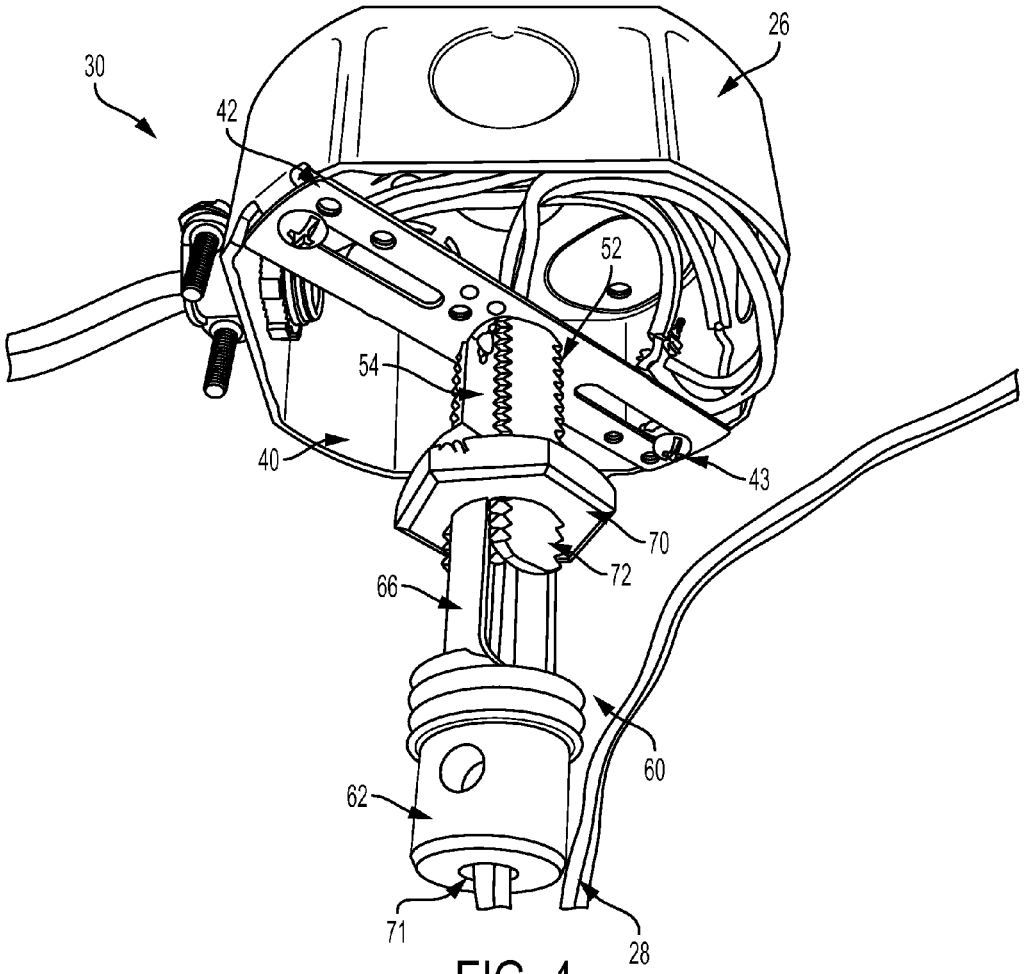
FIG. 4 is a perspective view of a light fixture mounting system in accordance with an exemplary embodiment of the invention illustrated connected to an exemplary electrical box.

Referring to FIGS. 4-10, an exemplary light fixture mounting assembly 30 in accordance with an exemplary embodiment of the invention will be described. With reference to FIG. 4, the mounting assembly 30 generally comprises a nipple assembly 40 and a fixture mount assembly 60. The mount assembly 30 is illustrated connected to an exemplary electrical box 26. While the invention is described in use with an electrical box 26, it is recognized that the mount assembly 30 may be utilized with other electrical structures and systems.

Figure 5:
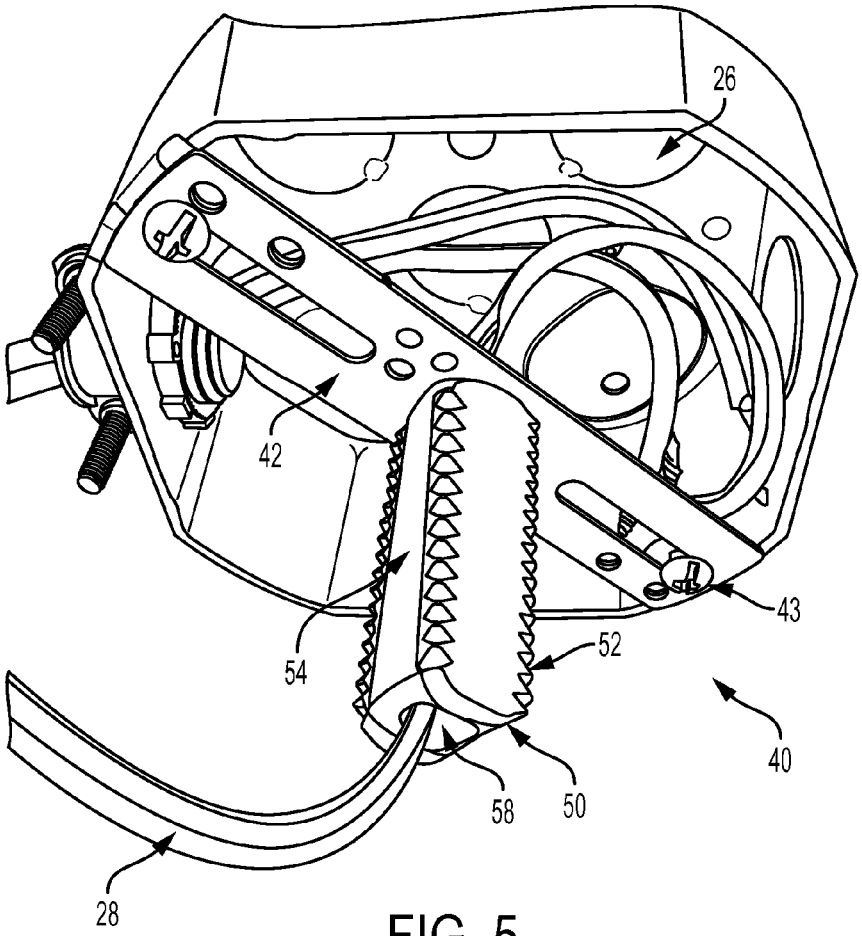
FIG. 5 is a perspective view of the nipple assembly of the mounting system of FIG. 4 illustrated connected to an exemplary electrical box.
Figure 6:
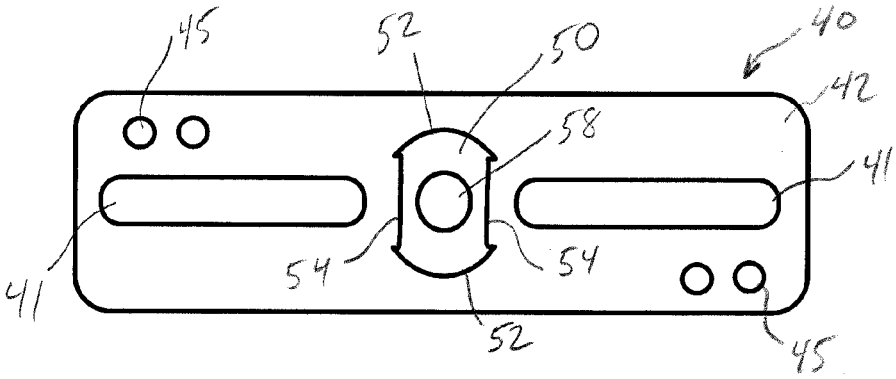
FIG. 6 is an end plan view of the nipple assembly of the mounting system of FIG. 4.

Referring to FIGS. 5 and 6, the exemplary nipple assembly 40 includes a crossbar 42 with a nipple 50 secured thereto. In the illustrated embodiment, the nipple 50 is welded to the crossbar 42 at 56. The nipple 50 may be constructed as an integral part of the crossbar or otherwise connected to the crossbar, for example, utilizing a locking nut. Preferably, once assembled, the nipple 50 is fixed against rotation relative to the crossbar 42. In the present embodiment, the crossbar 42 serves as a connector and includes a plurality of slots 41 and holes 45 configured for passage of screws 43 to connect the crossbar to the electrical box 26. Other connecting mechanisms, for example, spring clips or expanding screw clips, may be utilized to connect the crossbar 42 to the electrical box 26 or other structure. Additionally, the nipple 50 may be connected to another structure other than a crossbar, for example a plate, spring clips, which will serve as the connector.

The nipple 50 includes a pair of opposed longitudinal channels 54 with threads 52 extending over at least a portion of the remaining circumference of the nipple 50. The threads 52 are configured for threaded engagement with an adjusting nut as will be described hereinafter. The channels 54 are configured to receive corresponding prong legs on the fixture mount assembly 60 as will be described hereinafter. While two opposed channels 54 are illustrated and described, it is understood that the nipple 50 may include a single channel 54 or more than two channels 54. The number of channels 54 is at least equal to the number of prong legs on the fixture mount assembly 60. A bore 58 extends through the nipple 50 and crossbar 42 such that the passage of wires 28 or the like may be facilitated by passing through the nipple assembly 40 from the electrical box 26.

Figure 7:
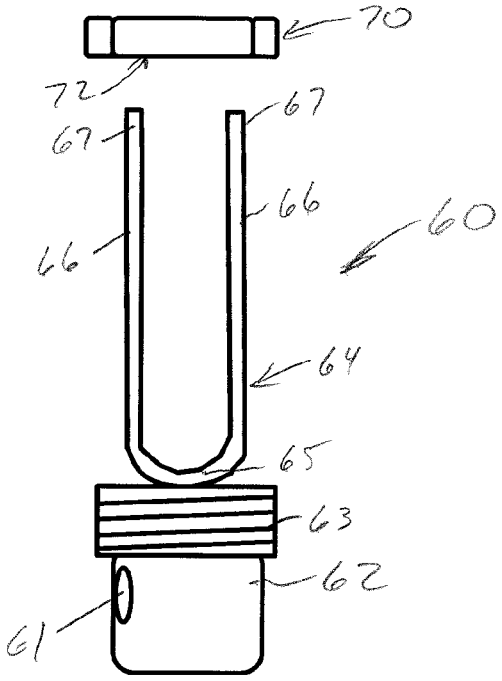
FIG. 7 is an elevation view of the fixture mount assembly of the mounting system of FIG. 4 prior to placement of the adjusting nut.
Figure 8:
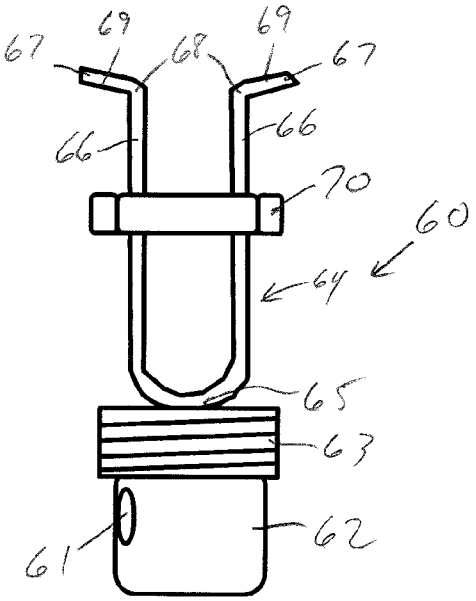
FIG. 8 is a view similar to FIG. 7 with the adjusting nut positioned and trapped on the prongs of the fixture mounting assembly.

Referring to FIGS. 7 and 8, the exemplary fixture mount assembly 60 will be described. The fixture mount assembly 60 includes a mount body 62 with one or more mounting structures. In the exemplary embodiment, the mount body 62 includes a through bore 61 for receiving an open chain link mounting loop (similar to loop 24 used for FIG. 1) and external threads 63 on the mounting structure to receive a canopy and tightening nut. A through bore 71 extends through the mount body 62 to facilitate passage of the wires 28 as illustrated in FIG. 4. While the through bore 71 may facilitate passage of the wires, such is not required and the wires may be otherwise run. It is evident in this design that a separate collar is not required but also that FIGS. 7 and 8 could be modified in keeping with this invention to provide for a collar loop with an appearance such as shown in FIG. 1 with threads and bore for a mounting loop from which the light fixture may subsequently be hung.

A prong assembly 64 extends from the mount body 62 from a fixed end 65 to a free end 67. In the illustrated embodiment, the prong assembly 64 includes a pair of spaced apart legs 66. As illustrated in FIG. 7, the prong legs 66 preferably initially extend straight such that the prong legs 66 may pass through the threaded opening 72 of the adjusting nut 70. After the adjusting nut 70 is positioned over the legs 66, the legs 66 are bent at 68 to form prong feet 69 which prevent the adjusting nut 70 from removal from the prong assembly 64 and so that the nut is a trapped adjusting nut. Other methods of manufacture may be utilized, for example, the adjusting nut may be passed over the fixed end 65 before the fixed end 65 is connected to the mount body 62. With the adjusting nut 70 positioned on the prong assembly 64, the fixture mount assembly 60 is ready for use with the nipple assembly 40.

Figure 9:
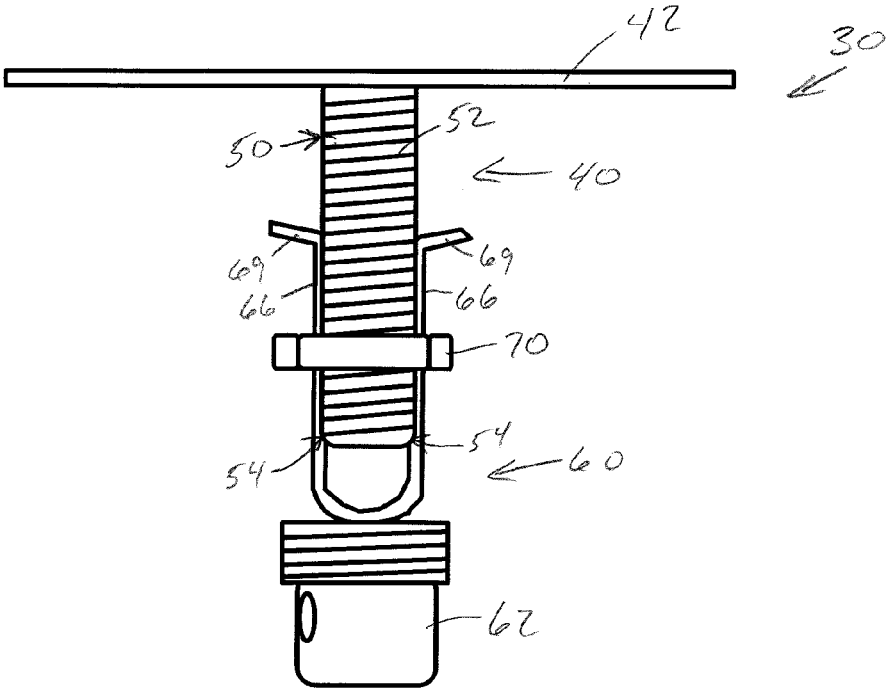
FIG. 9 is an elevation view illustrating an initial assembly position between the nipple assembly and the fixture mounting assembly.
Figure 10:
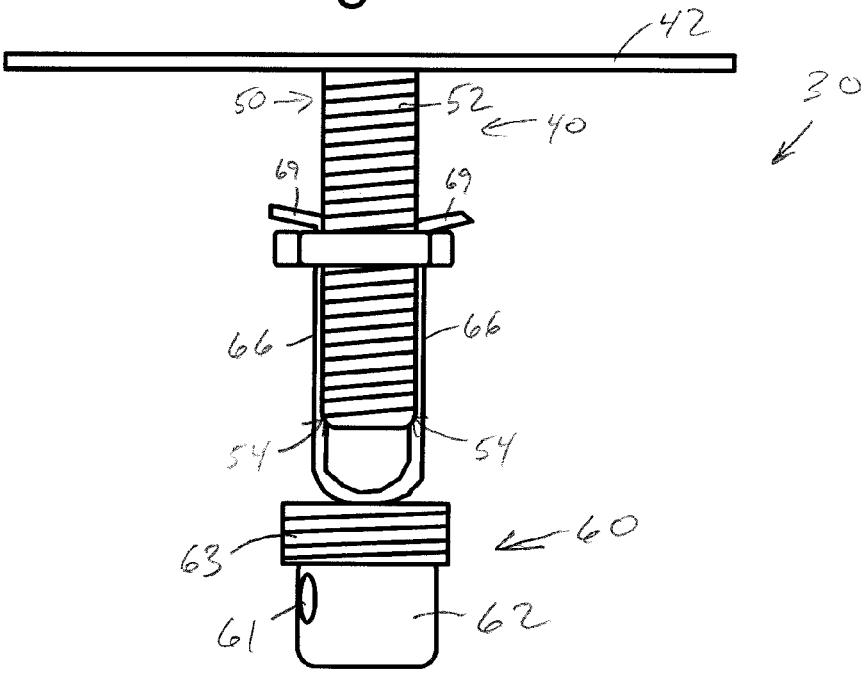
FIG. 10 is an elevation view similar to FIG. 9 illustrating a final assembly configuration.

Referring to FIGS. 4 and 9-10, operation of the mount assembly 30 will be described. With reference to FIG. 9, the fixture mount assembly 60 is initially positioned relative to the nipple assembly 40 such that each prong leg 66 is received in a respective channel 54. The adjusting nut 70 is threadably connected to the nipple 50 via the threads 52. In the initial position illustrated in FIG. 9, the legs 66 are longitudinally moveable within the channels 54 such that the position of the mount body 62 relative to the crossbar 42 may be adjusted.

Referring to FIG. 10, with the mount body 62 in a desired position, the adjusting nut 70 is adjusted to a final desired position wherein the adjusting nut 70 contacts the prong feet 69 extending from the respective prong legs 66. With the adjusting nut 70 in this position, contact with the prong feet 69 prevents the fixture mount assembly 60 from turning away from the crossbar 42, thereby fixing the fixture mount assembly 60 for supporting of a light fixture utilizing one of the mounting structures. Additionally, because each prong leg 66 is received in a channel 54, the fixture mount assembly 60 is prevented from rotation relative to the nipple assembly 40. As such, the fixture mount assembly 60 is prevented from inadvertent unscrewing from the nipple assembly 40 or the crossbar. Instead, to turn or remove the fixture mount assembly 60, the adjusting nut 70 must be intentionally unscrewed from the nipple assembly 50. Yet, the adjusting nut can be utilized to adjust the height of the light mounting assembly without the need for complete disassembly of the installed system.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A light fixture mounting system for mounting a light fixture relative to a structure, the system comprising:

a nipple assembly configured to be secured relative to the structure, the nipple assembly including a longitudinally extending nipple with at least one longitudinal channel and a series of outer threads extending over at least a portion of the longitudinal length of the nipple; and a fixture mount assembly including a mount body defining at least one mounting structure, a prong assembly extending from the mount body and including at least one prong leg extending to a free end with an outwardly extending prong foot, and an adjusting nut positioned about the at least one prong leg between the mount body and the respective prong foot;

wherein the fixture mount assembly is configured to be positioned relative to the nipple assembly such that each prong leg is positioned in a corresponding longitudinal channel and the adjusting nut is tightened about the outer threads such that the adjusting nut contacts the at least one prong foot and the at least one prong leg is retained in the corresponding longitudinal channel.

2. The light fixture mounting assembly according to claim 1 wherein the prong assembly includes two spaced apart prong legs and the nipple includes at least two longitudinal channels.

3. The light fixture mounting assembly according to claim 2 wherein the nipple includes two opposed longitudinal channels.

4. The light fixture mounting assembly according to claim 1 wherein the nipple assembly further comprises a crossbar and the nipple is connected to the crossbar.

5. The light fixture mounting assembly according to claim 4 wherein the nipple is fixed against rotation relative to the crossbar.

6. The light fixture mounting assembly according to claim 5 wherein the nipple is welded to the crossbar.

7. The light fixture mounting assembly according to claim 4 wherein the crossbar includes at least two through passages configured for receipt of screws for connection of the nipple assembly to the structure.

8. The light fixture mounting assembly according to claim 1 wherein the mounting structure includes at least one external thread.

9. The light fixture mounting assembly according to claim 1 wherein the mounting structure includes a bore configured to support a mounting loop.

10. The light fixture mounting assembly according to claim 1 wherein a longitudinal bore extends through the nipple and a corresponding longitudinal bore extends through the mount body.

* * * * *